US006821195B1

(12) United States Patent
Pham et al.

(10) Patent No.: US 6,821,195 B1
(45) Date of Patent: Nov. 23, 2004

(54) CARRIER HEAD HAVING LOCATION OPTIMIZED VACUUM HOLES

(75) Inventors: Xuyen Pham, Fremont, CA (US); Ren Zhou, Fremont, CA (US); Raisa Khavinson, Mountain View, CA (US)

(73) Assignee: Lam Research Corporation, Fremont, CA (US)

( * ) Notice: Subject to any disclaimer, the term of this patent is extended or adjusted under 35 U.S.C. 154(b) by 19 days.

(21) Appl. No.: 10/187,228

(22) Filed: Jun. 28, 2002

(51) Int. Cl.[7] ..... B24B 19/00
(52) U.S. Cl. ..... 451/388; 269/21
(58) Field of Search ..... 451/388, 285–289, 451/4, 53, 384, 397; 269/21

(56) References Cited

U.S. PATENT DOCUMENTS 5,733,182 A * 3/1998 Muramatsu et al. ..... 451/289
5,762,539 A * 6/1998 Nakashiba et al. ..... 451/41
6,358,129 B2 * 3/2002 Dow ..... 451/285

* cited by examiner

*Primary Examiner*—Lee D. Wilson
(74) *Attorney, Agent, or Firm*—Martine & Penilla, LLP

(57) ABSTRACT

An invention is provided for a carrier head for use in a CMP process. The carrier head includes a metal plate that is capable of transferring a downforce to a wafer during a CMP operation. A plurality of vacuum holes is disposed within the metal plate, wherein each vacuum hole is positioned such that the vacuum hole is within five millimeters of an edge of the wafer during the CMP operation. In this manner, each vacuum hole can be positioned such that the vacuum hole is within an edge exclusion zone of the wafer during the CMP operation. In some embodiments, each vacuum hole is positioned such that the vacuum hole is within three millimeters of the edge of the wafer during the CMP operation, such as 2.7 millimeters from the edge of the wafer.

20 Claims, 8 Drawing Sheets

CARRIER HEAD HAVING LOCATION OPTIMIZED VACUUM HOLES

BACKGROUND OF THE INVENTION

1. Field of the Invention

This invention relates generally to chemical mechanical planarization, and more particularly to a carrier head having location optimized vacuum holes for reducing non-uniformity film effect during a chemical mechanical planarization process.

2. Description of the Related Art

In the fabrication of semiconductor devices, planarization operations are often performed, which can include polishing, buffing, and wafer cleaning. Typically, integrated circuit devices are in the form of multi-level structures. At the substrate level, transistor devices having diffusion regions are formed. In subsequent levels, interconnect metallization lines are patterned and electrically connected to the transistor devices to define the desired functional device. Patterned conductive layers are insulated from other conductive layers by dielectric materials, such as silicon dioxide.

As more metallization levels and associated dielectric layers are formed, the need to planarize the dielectric material increases. Without planarization, fabrication of additional metallization layers becomes substantially more difficult due to the higher variations in the surface topography. In other applications, metallization line patterns are formed in the dielectric material, and then metal planarization operations are performed to remove excess metallization. Further applications include planarization of dielectric films deposited prior to the metallization process, such as dielectrics used for shallow trench isolation or for poly-metal insulation. One method for achieving semiconductor wafer planarization is the chemical mechanical planarization (CMP) process.

In general, the CMP process involves holding and rubbing a typically rotating wafer against a moving polishing pad under a controlled pressure and relative speed. CMP systems typically implement orbital, belt, or brush stations in which pads or brushes are used to scrub, buff, and polish one or both sides of a wafer. Slurry is used to facilitate and enhance the CMP operation. Slurry is most usually introduced onto a moving preparation surface and distributed over the preparation surface as well as the surface of the semiconductor wafer being buffed, polished, or otherwise prepared by the CMP process. The distribution is generally accomplished by a combination of the movement of the preparation surface, the movement of the semiconductor wafer and the friction created between the semiconductor wafer and the preparation surface.

An effective CMP process has a high polishing rate and generates a substrate surface which is both finished, that is, lacks small-scale roughness, and flat, meaning that the surface lacks large-scale topography. The polishing rate, finish and flatness are determined by the pad and slurry combination, the relative speed between the substrate and pad, and the force pressing the substrate against the pad.

The polishing rate depends upon the force pressing the substrate against the pad. Specifically, the greater this force, the higher the polishing rate. If the carrier head applies a non-uniform load, i.e., if the carrier head applies less force to one region of the substrate than to another, then the low pressure regions will be polished slower than the high pressure regions. Therefore, a non-uniform load may result in non-uniform polishing of the substrate.

FIG. 1 is an illustration showing a conventional carrier head 100, which includes a stainless steel plate 104 surrounded by a retaining ring 102 for holding a wafer in position during polishing. Typically, a carrier film (not shown) positioned within the retaining ring 102 covers the stainless steel plate 104. In addition, vacuum holes 106 are positioned in the stainless steel plate 104 at a particular distance $D_{108}$, typically about 14.3 millimeters (mm) in the conventional carrier head 100, from the edge of the stainless steel plate 104.

The carrier film is designed to absorb pressure during wafer polishing, thus preventing hot pressure spots from occurring on the wafer surface. In the present disclosure, the term "hot pressure spots" refers to wafer surface areas wherein increased downforce pressure results in a higher removal rate for that wafer surface area. Thus, hot pressure spots can result in non-uniformity problems during CMP processing, which are generally avoided by the use of the carrier film.

During wafer processing, the wafer must be transported from station to station. To facilitate wafer transportation, the carrier head 100 includes vacuum holes 106 that allow the carrier head 100 to pick up and drop off the wafer. For example, after completing a polishing operation, the carrier head 100 transports the wafer from the surface of the polishing belt to the next station in the wafer fabrication process. However, the wafer often experiences "stiction" with the polishing belt. That is, the combination of the polyurethane of the polishing belt surface and the slurry often causes the wafer to adhere to the surface of the polishing belt. To break this adhesion, the carrier head 100 applies a vacuum to the back of the wafer via the vacuum holes 106, which allows the carrier head 100 to lift the wafer from the surface of the polishing belt. After transporting the wafer to the next wafer fabrication station, the carrier head 100 applies a positive airflow through the vacuum holes 106 to release the wafer from the carrier film of the carrier head 100.

Unfortunately, the vacuum holes 106 of the carrier head 100 cause low removal rate areas on the surface of the wafer, which result in non-uniformity errors. FIG. 2 is a diagram showing an exemplary wafer 200 resulting from CMP operations using the conventional carrier head of FIG. 1. During the CMP process the carrier film on the carrier head is wet. However, when vacuum is applied through the carrier head vacuum holes, the vacuum tends to dry out the carrier film around the vacuum holes, which can make the carrier film softer in the regions of the vacuum holes. In addition, there is no direct wafer support in the regions of the vacuum holes. Thus, because of the dry carrier film and lack of wafer support in the region of the vacuum holes, the low removal rate "vacuum hole" regions 202 occur on the surface of the wafer 200. The resulting non-uniformity can have a dramatic negative affect on the devices formed on the wafer, often causing the effected dice at this area to be discarded.

Carrier heads have been developed that attempt to avoid low removal rate vacuum hole regions on the surface of the wafer. For example, one conventional carrier head uses an inflatable bladder essentially in place of the stainless steel plate to transfer downforce to the back of the wafer during the CMP process. However, this inflatable bladder requires a floating retaining ring that complicates the CMP process. Moreover, the floating retaining ring generally causes undesirable edge effects, wherein the removal rate at the edge of the wafer is very high with respect to the remainder of the wafer.

In view of the foregoing, there is a need for a carrier head that avoids low removal rate vacuum hole regions on the surface of the wafer. The carrier head should be usable on various types of CMP systems, and should not require undue experimentation and engineering to implement. In particular, the carrier head should not require overly complex systems, such as a floating retaining ring, and should provide a uniform wafer surface during CMP.

SUMMARY OF THE INVENTION

Broadly speaking, the present invention fills these needs by providing a carrier head having location optimized vacuum holes for improved uniformity during CMP operations. Generally, embodiments of the present invention relocate the vacuum holes of the carrier head to within the edge exclusion zone of the wafer. In one embodiment, a carrier head for use in a CMP process is disclosed. The carrier head includes a metal plate that is capable of transferring a downforce to a wafer during a CMP operation. A plurality of vacuum holes is disposed within the metal plate, wherein each vacuum hole is positioned such that the vacuum hole is within five millimeters of an edge of the wafer during the CMP operation. In this manner, each vacuum hole can be positioned such that the vacuum hole is within an edge exclusion zone of the wafer during the CW operation. In some embodiments, each vacuum hole is positioned such that the vacuum hole is within three millimeters of the edge of the wafer during the CMP operation, such as 2.7 millimeters from the edge of the wafer.

A method for making a carrier head for use in a CMP process is disclosed in a further embodiment of the present invention. The method includes providing a metal plate that is capable of transferring a downforce to a wafer during a CMP operation, and boring a plurality of substantially horizontal air channels from the edge of the metal plate toward the center of the metal plate. In addition, a plurality of air ports are drilled into the metal plate. Each air port is located within five millimeters of the edge of the metal plate and is connected to an air channel. Further, the axis of each air port forms an angle greater than 90° toward the center of the metal plate and relative to a plane that is parallel to the surface of the metal plate and in a plane substantially perpendicular to the surface of the metal plate. In this manner, an end of each air port forms a vacuum hole in the surface of the metal plate. Generally, an end of each horizontal air channel present at the edge of the metal plate is plugged. Further, each air port generally is capable of providing air pressure toward the center of the wafer to release the wafer from the carrier head.

An additional carrier head for use in a CMP process is disclosed in a further embodiment of the present invention. As above, the carrier head includes a metal plate capable of transferring a downforce to a wafer during a CMP operation. Further, a plurality of substantially horizontal air channels extend from the edge of the metal plate toward a center of the metal plate. Also, a plurality of vacuum holes are disposed within the metal plate and are connected to the plurality of air channels via air ports. As above, an axis of each air port forms an angle greater than 90° relative to a plane that is parallel to a surface of the wafer toward a center of the wafer. In addition, each vacuum hole is positioned such that the vacuum hole is within an edge exclusion zone of the wafer during the CMP operation.

Embodiments of the present invention can be advantageously utilized to polish wafers without generating low removal rate vacuum hole regions of the wafer surface. In particular, each vacuum hole is positioned within the edge exclusion zone of the wafer during the CMP operation. Because devices are not fabricated in this area of the wafer, removal rates are much less important within the edge exclusion of the wafer.

Further, the edge of a wafer is much more ridged than the center areas of the wafer. Thus, the physics of the wafer itself make points on the edge of the wafer much stiffer than points located more centrally on the wafer. As a result, the vacuum holes have much less affect on the wafer removal rate when located within 3 millimeters of the wafer's edge, such as when located at 2.7 millimeters from the edge of the wafer. Other aspects and advantages of the invention will become apparent from the following detailed description, taken in conjunction with the accompanying drawings, illustrating by way of example the principles of the invention.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE PREFERRED EMBODIMENTS

An invention is disclosed for a carrier head having location optimized vacuum holes for improved uniformity during CMP operations. Embodiments of the present invention relocate the vacuum holes of the carrier head to within the edge exclusion zone of the wafer. In this manner, low removal rate vacuum hole regions are avoided on the surface of the wafer. In the following description, numerous specific details are set forth in order to provide a thorough understanding of the present invention. It will be apparent, however, to one skilled in the art that the present invention may be practiced without some or all of these specific details. In other instances, well known process steps have not been described in detail in order not to unnecessarily obscure the present invention.

Figure 3A:
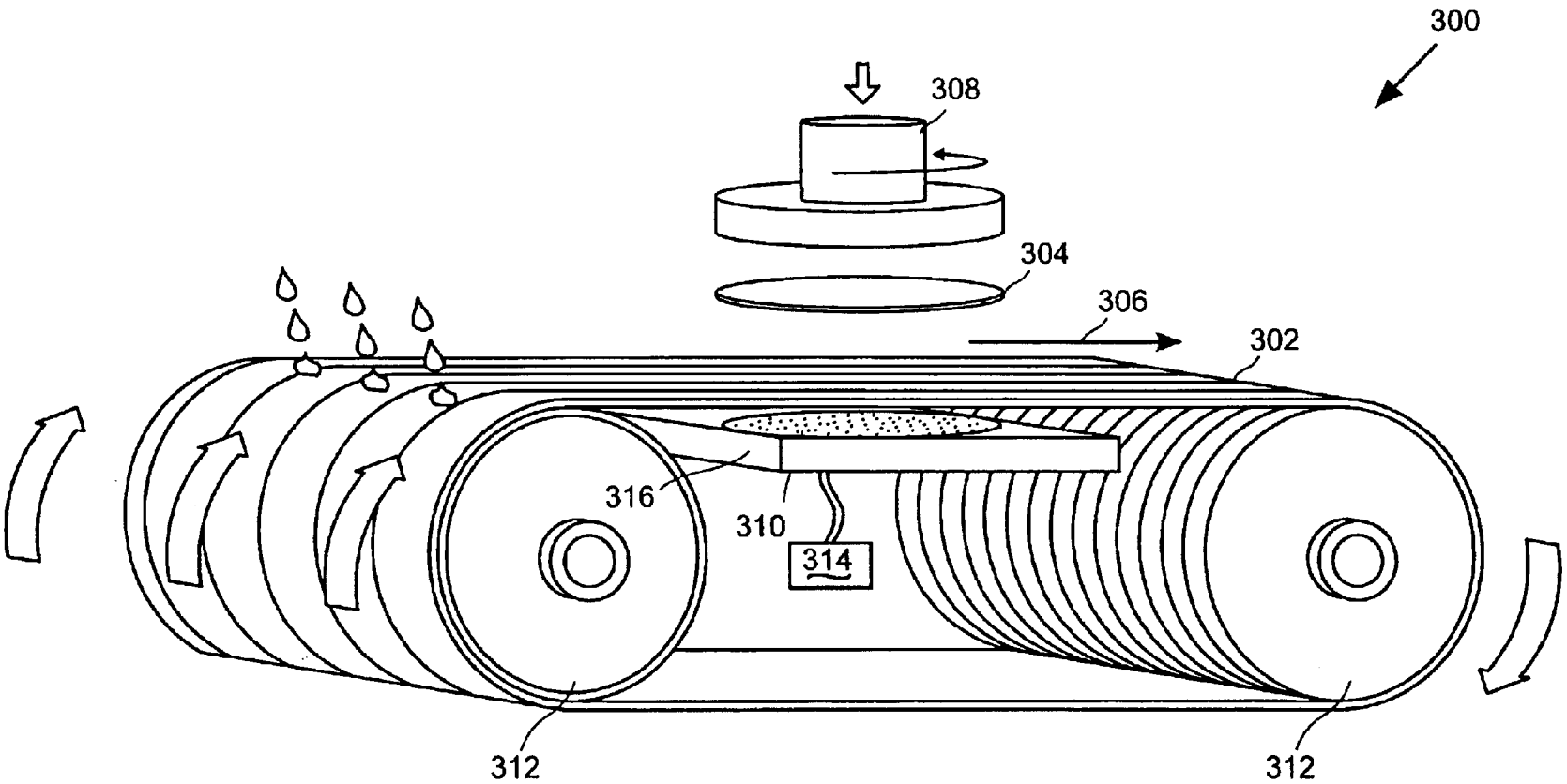
FIG. 3A shows a side view of a linear wafer polishing apparatus having a carrier head with location optimized vacuum holes, in accordance with an embodiment of the present invention.

Embodiments of the present invention can be utilized in various CMP systems, such as table based CMP systems and linear CMP systems. For completeness, a brief description of these CMP systems follows, which clarifies the relation and location of the carrier head of the embodiments of the present invention within CMP systems. FIG. 3A shows a side view of a linear wafer polishing apparatus 300 having a carrier head 308 with location optimized vacuum holes, in accordance with an embodiment of the present invention. The linear wafer polishing apparatus 300 includes a carrier head 308, which secures and holds a wafer 304 in place during processing. A polishing pad 302 forms a continuous loop around rotating drums 312, and generally moves in a direction 306 at a speed of about 400 feet per minute, however this speed may vary depending upon the specific CMP operation. As the polishing pad 302 moves, the carrier head 308 rotates and lowers the wafer 304 onto the top surface of the polishing pad 302, loading it with required polishing pressure.

A bearing platen manifold assembly 310 supports the polishing pad 302 during the polishing process. The platen manifold assembly 310 may utilize any type of bearing such as a fluid bearing or a gas bearing. The platen manifold assembly 310 is supported and held into place by a platen surround plate 316. Gas pressure from a gas source 314 is inputted through the platen manifold assembly 310 via a plurality of independently controlled of output holes that provide upward force on the polishing pad 302 to control the polishing pad profile. In addition to the linear belt CMP apparatus 300 discussed above, embodiments of the present invention can be used with table based CMP systems.

Figure 3B:
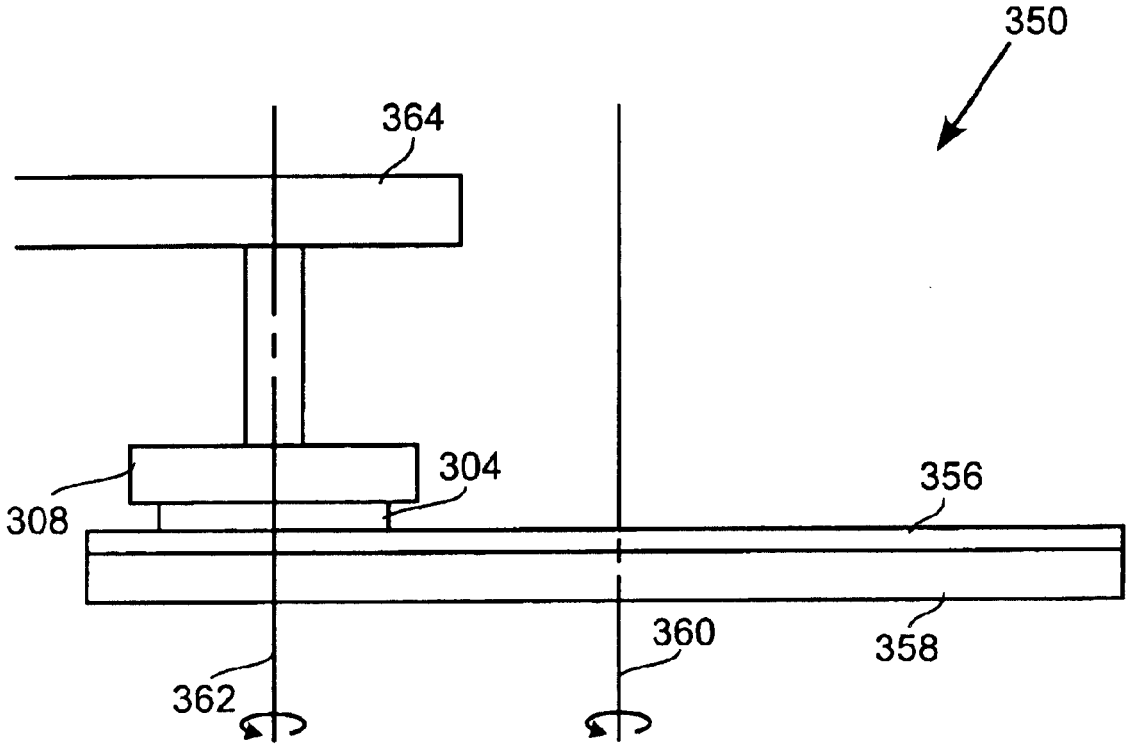
FIG. 3B is a diagram showing a table based CMP apparatus, having a carrier head with location optimized vacuum holes, in accordance with an embodiment of the present invention.

FIG. 3B is a diagram showing a table based CMP apparatus 350, having a carrier head 308 with location optimized vacuum holes, in accordance with an embodiment of the present invention. The table based CMP apparatus 350 includes a carrier head 308, which holds a wafer 304, and is attached to a translation arm 364. In addition, the table based CMP apparatus 350 includes a polishing pad 356 that is disposed above a polishing table 358, which is often referred to as a polishing platen.

In operation, the carrier head 308 applies downward force to the wafer 304, which contacts the polishing pad 356. Reactive force is provided by the polishing table 358, which resists the downward force applied by the carrier head 308. A polishing pad 356 is used in conjunction with slurry to polish the wafer 304. Typically, the polishing pad 356 comprises foamed polyurethane or a sheet of polyurethane having a grooved surface. The polishing pad 356 is wetted with a polishing slurry having both an abrasive and other polishing chemicals. In addition, the polishing table 358 is rotated about its central axis 360, and the carrier head 308 is rotated about its central axis 362. Further, the polishing head can be translated across the polishing pad 356 surface using the translation arm 364.

As discussed previously, wafers generally must be transported from station to station, and to facilitate wafer transportation, the carrier heads include vacuum holes that allow the carrier head to pick up and drop off the wafer. Unfortunately, the vacuum holes of conventional carrier heads cause low removal rate areas on the surface of the wafer, resulting in non-uniformity errors. Embodiments of the present invention prevent these low removal rate areas from occurring on the surface of the wafer by relocating the vacuum holes of the carrier head to within the edge exclusion zone of the wafer.

Figure 4:
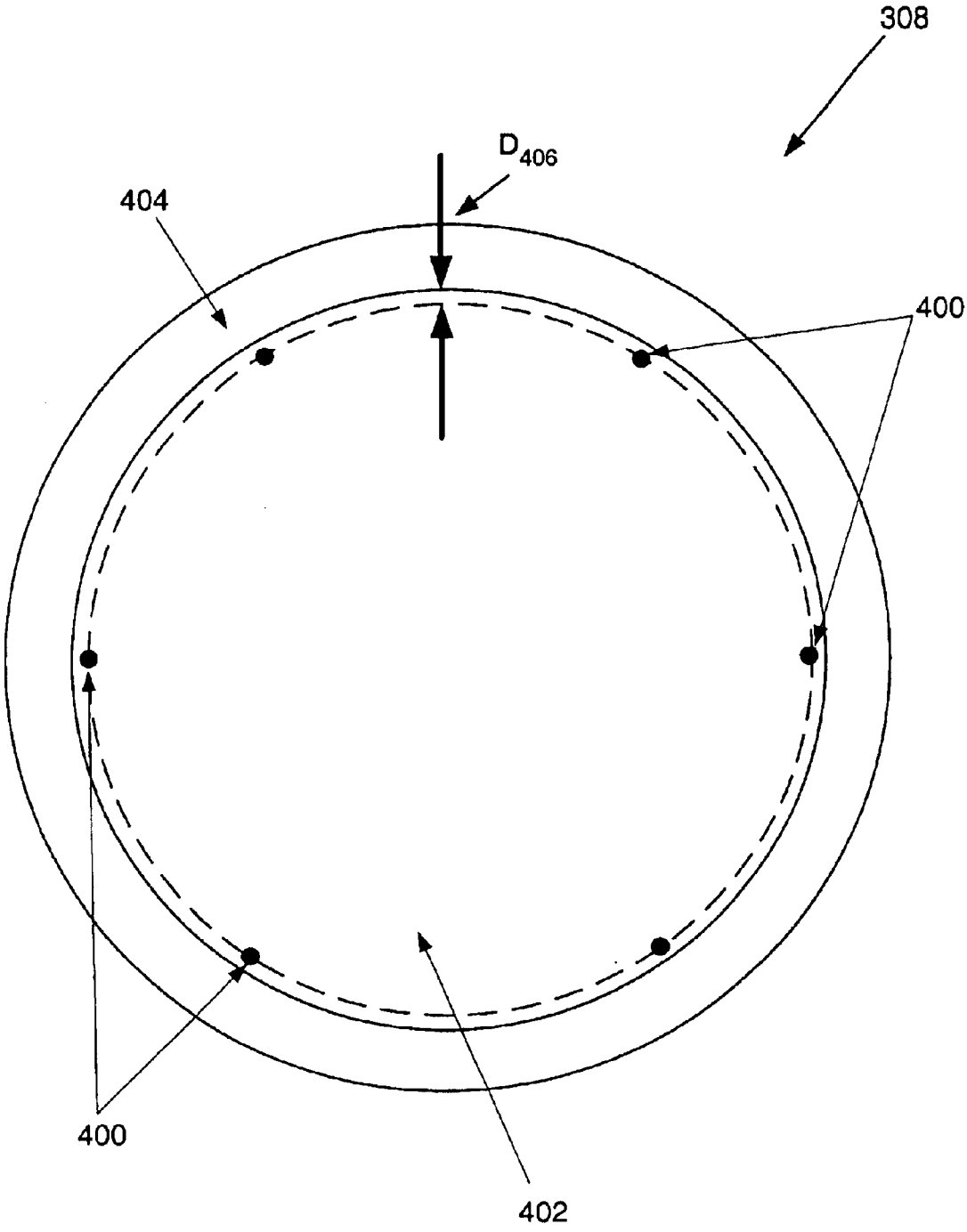
FIG. 4 is a bottom view of a carrier head having location optimized vacuum holes, in accordance with an embodiment of the present invention.

FIG. 4 is a bottom view of a carrier head 308 having location optimized vacuum holes 400, in accordance with an embodiment of the present invention. The carrier head 308 includes a stainless steel plate 402 surrounded by a retaining ring 404, which holds a wafer in position during polishing. During actual polishing a carrier film (not shown) is positioned between the stainless steel plate 402 and the backside of the wafer. The carrier film is designed to absorb pressure during wafer polishing, thus preventing hot pressure spots from occurring on the wafer surface. Hot pressure spots can result in non-uniformity problems during CMP processing, which are generally avoided by the use of the carrier film.

Figure 1:
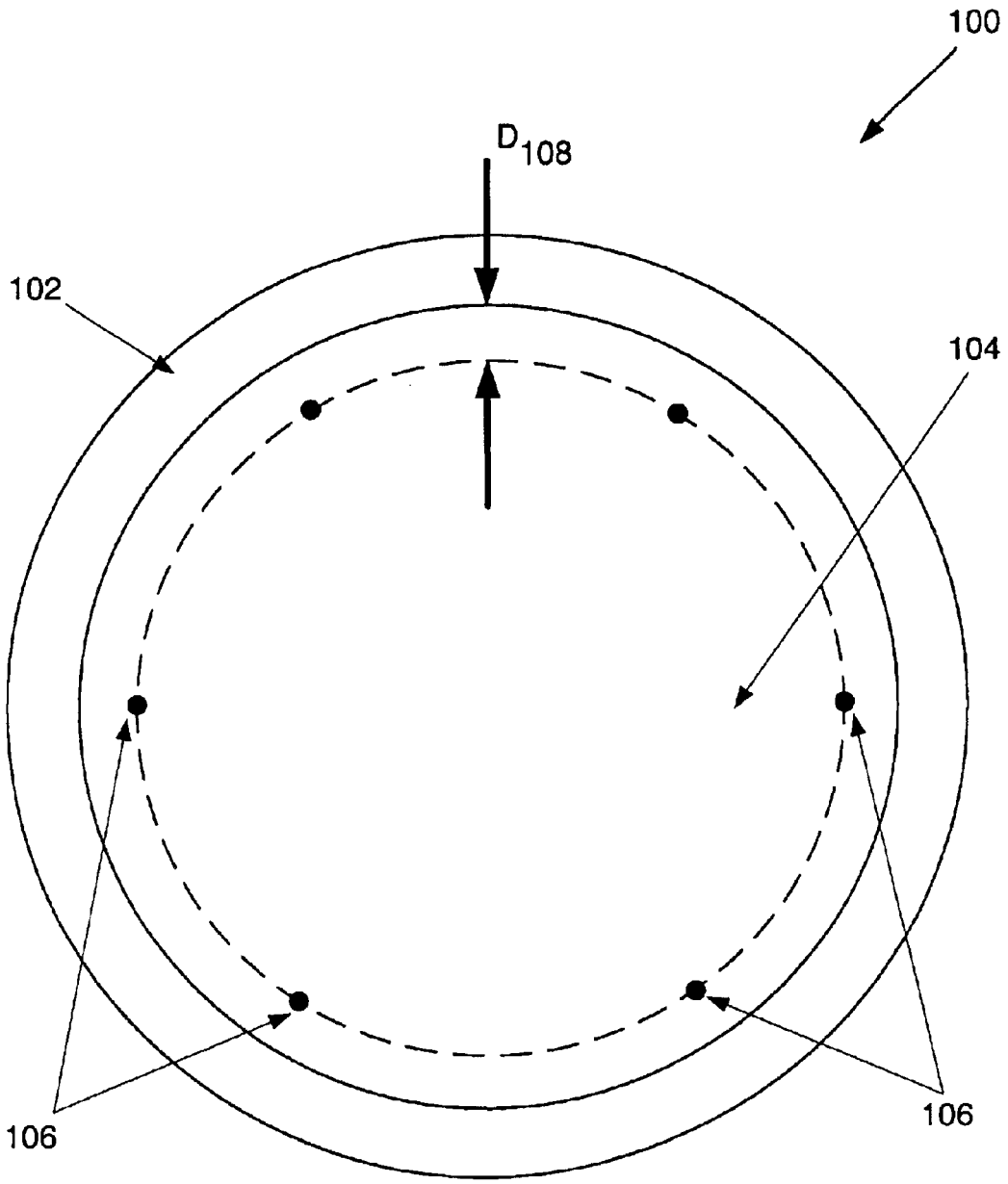
FIG. 1 (Prior Art)
FIG. 1 is an illustration showing a conventional carrier head.
Figure 2:
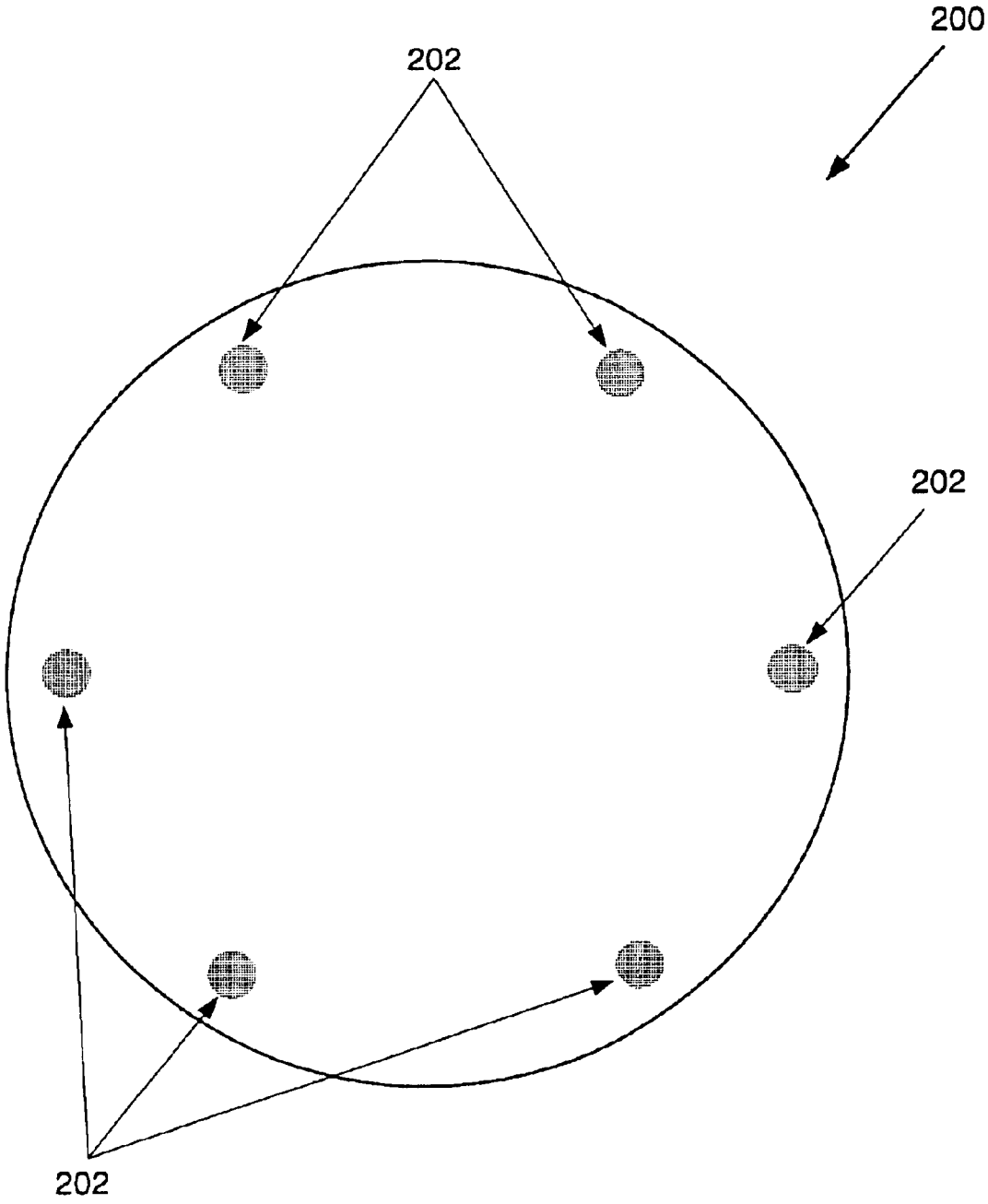
FIG. 2 (Prior Art)
FIG. 2 is a diagram showing an exemplary wafer resulting from CMP operations using the conventional a carrier head of FIG. 1.

As shown in FIG. 4, the carrier head 308 also includes a plurality of vacuum holes disposed within the stainless steel plate. However, unlike the conventional carrier head described above with reference to FIG. 1, each vacuum hole 400 of the carrier head 308 is positioned such that the vacuum hole 400 is within five millimeters of an edge of the wafer during the CMP operation. Preferably, each vacuum hole 400 is positioned within three millimeters of the edge of the wafer during the CMP operation. For example, in FIG. 4, the distance $D_{406}$ can be 2.7 millimeters.

As a result, each vacuum hole is positioned within the edge exclusion zone of the wafer during the CMP operation. The edge exclusion zone of a wafer is an area along the edge of a wafer wherein dies are not fabricated. Because devices are not fabricated in this area of the wafer, removal rates are much less important within the edge exclusion of the wafer. Further, the edge of a wafer is much more ridged than the center areas of the wafer. Thus, the physics of the wafer itself make points on the edge of the wafer much stiffer than points located more centrally on the wafer. As a result, the vacuum holes 400 have much less affect on the wafer removal rate when located within 3 millimeters of the wafer's edge, such as when the distance $D_{406}$ is 2.7 millimeters.

Figure 5:
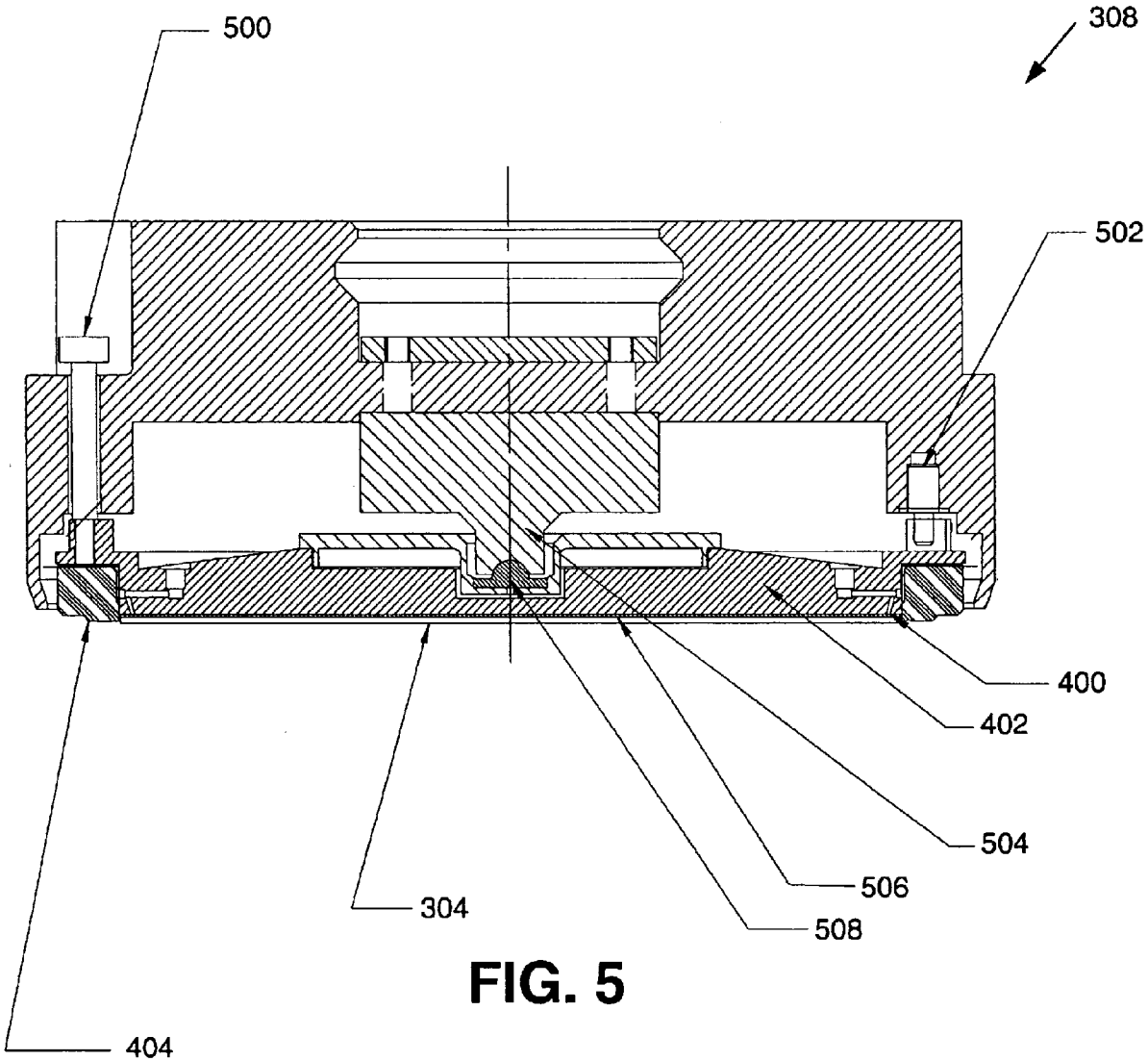
FIG. 5 is a side view of a carrier head having location optimized vacuum holes, in accordance with an embodiment of the present invention.

FIG. 5 is a side view of a carrier head 308 having location optimized vacuum holes 400, in accordance with an embodiment of the present invention. As above, the carrier head 308 includes a stainless steel plate 402 surrounded by a retaining ring 404, which holds a wafer 304 in position during polishing. Retaining bolts 500 are utilized to attach the retaining ring 404 to the carrier head 308, and shear pins 502 are used to transfer rotation from the carrier head 308 to the stainless steel plate 402. For increased flexibility, a gimbal post 504 is used in conjunction with a gimbal center 508 to allow the stainless steel plate 402 to more easily conform to the polishing surface.

In addition, a carrier film 506 is positioned between the stainless steel plate 402 and the backside of the wafer 304. As mentioned above, the carrier film is designed to absorb pressure during wafer polishing, thus preventing hot pressure spots from occurring on the wafer surface. As mentioned above, hot pressure spots can result in non-uniformity problems during CMP processing, which are generally avoided by the use of the carrier film.

The carrier head 308 also includes a plurality of vacuum holes 400 disposed within the stainless steel plate. As discussed above, each vacuum hole 400 of the carrier head 308 is positioned such that the vacuum hole 400 is within five millimeters of an edge of the wafer during the CMP operation. Preferably, each vacuum hole 400 is positioned within three millimeters of the edge of the wafer during the CMP operation, such as when the distance $D_{406}$ is 2.7 millimeters.

The vacuum holes 400 allow the carrier head 308 to pick up and drop off the wafer 304. After completing a polishing operation, the carrier head 308 generally transports the wafer 304 from the surface of the polishing belt to the next station in the wafer fabrication process. However, the wafer often experiences "stiction" with the polishing belt. That is, the combination of the polyurethane of the polishing belt surface and the slurry often causes the wafer 304 to adhere to the surface of the polishing belt. To break this adhesion, the carrier head 308 applies a vacuum to the back of the wafer via the vacuum holes 400, which allow the carrier head 308 to lift the wafer 304 from the surface of the polishing belt.

Because of the porous nature of the carrier film 506, the vacuum transfers through the vacuum holes 400 and the carrier film 506 to the backside of the wafer 304. In this manner, the adhesion of the wafer 304 to the carrier head 308 resulting from the vacuum overcomes the surface tension between the wafer 304 and the polishing belt, thus allowing the carrier head 308 to lift the wafer 304.

In addition, the vacuum holes 400 can be used to release the wafer 304 from the carrier head 308. However, because of the proximity of the vacuum holes 400 to the edge of the wafer 304, embodiments of the present invention direct air from the vacuum holes 400 towards the center of the carrier head 308 to release the wafer 304, as discussed next with reference to FIG. 6.

Figure 6:
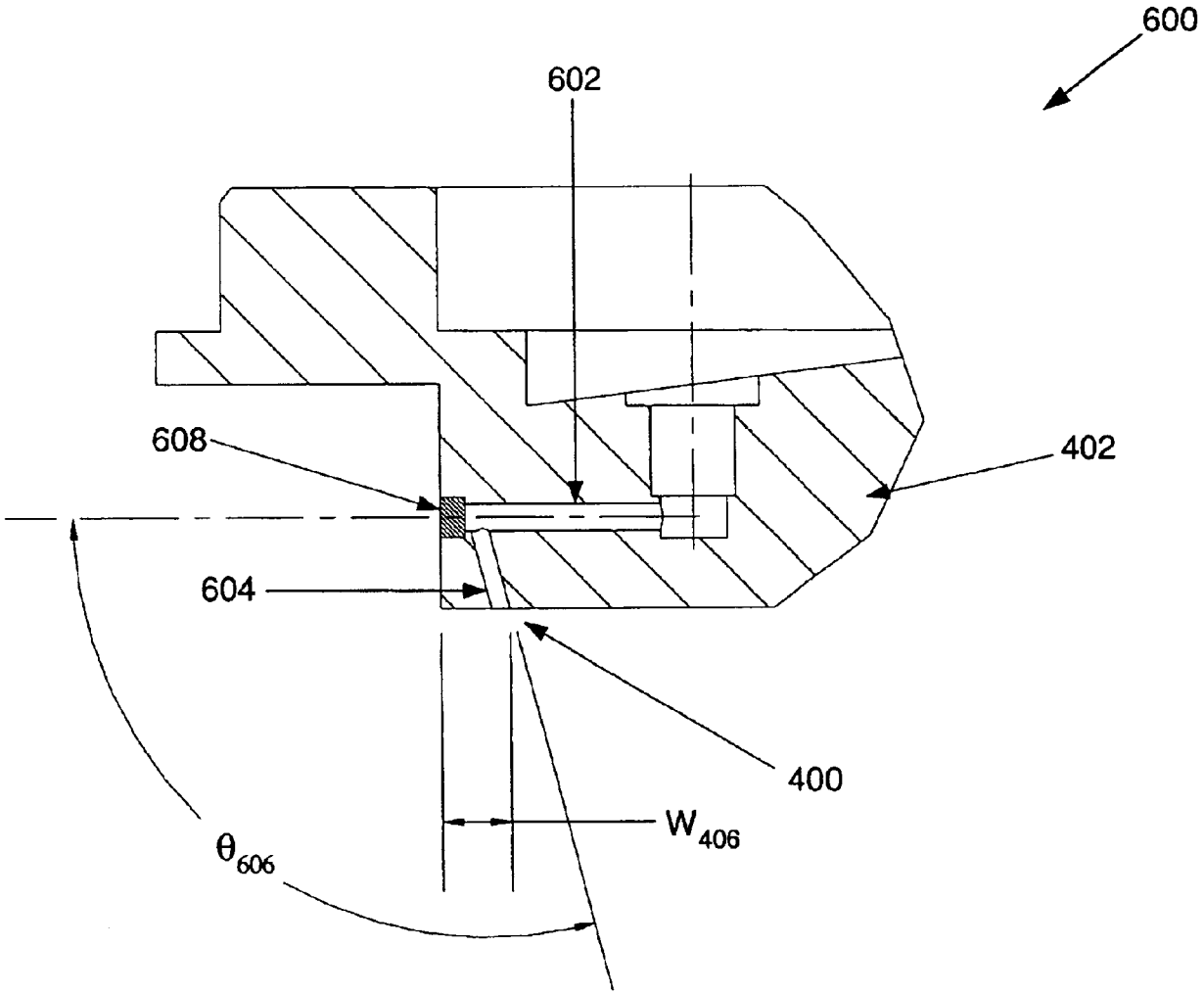
FIG. 6 is an expanded view of a vacuum/air port assembly, in accordance with an embodiment of the present invention.

FIG. 6 is an expanded view of a vacuum/air port assembly 600, in accordance with an embodiment of the present invention. The vacuum/air port assembly 600 is located at the edge of the stainless steel plate 402, and includes an air channel 602 connected to an air port 604, which ends in a vacuum hole 400. To facilitate manufacturing, the air channel 602 can be drilled from the edge of the stainless steel plate 402. Thereafter, an air channel plug 608 can be used to prevent air from escaping through the edge of the stainless steel plate 402.

As mentioned above, the vacuum hole 400 is positioned such that the vacuum hole 400 is within five millimeters of an edge of the wafer during the CMP operation. Preferably, each vacuum hole 400 is positioned within three millimeters of the edge of the wafer during a CMP operation, for example, the distance $D_{406}$ can be 2.7 millimeters.

In addition, the air port 604 is manufactured in an angle $\theta_{606}$. Preferably, the angle $\theta_{606}$ is greater than 90° relative to a plane that is parallel to the surface of the wafer. In addition, the angle $\theta_{606}$ preferably is configured to tilt directionally toward the center of the wafer and in a plane substantially perpendicular to the surface of the wafer, so as to define the angle $\theta_{606}$ as shown in FIG. 6. Preferably, the angle $\theta_{606}$ is in a range of about 90° to 145°.

After transporting the wafer to its destination, air is provided through the air channels 602 and connecting air ports 604, and out the vacuum holes 400. Since the air ports 604 are tilted toward the center of the wafer, the air pressure is provided toward the center of the wafer and shears the wafer from the surface of the carrier film. The tilt of the air ports 602 prevents the air pressure from escaping out the edge of wafer, which would prevent release of the wafer.

Using the carrier head 308 described above, embodiments of the present invention can be advantageously utilized to polish wafers without generating low removal rate vacuum hole regions of the wafer surface. In particular, each vacuum hole 400 is positioned within the edge exclusion zone of the wafer during the CMP operation. Because devices are not fabricated in this area of the wafer, removal rates are much less important within the edge exclusion of the wafer. Further, the edge of a wafer is much more ridged than the center areas of the wafer. Thus, the physics of the wafer itself make points on the edge of the wafer much stiffer than points located more centrally on the wafer. As a result, the vacuum holes 400 have much less affect on the wafer removal rate when located within 3 millimeters of the wafer's edge, such as when the distance $D_{406}$ is 2.7 millimeters.

Figure 7:
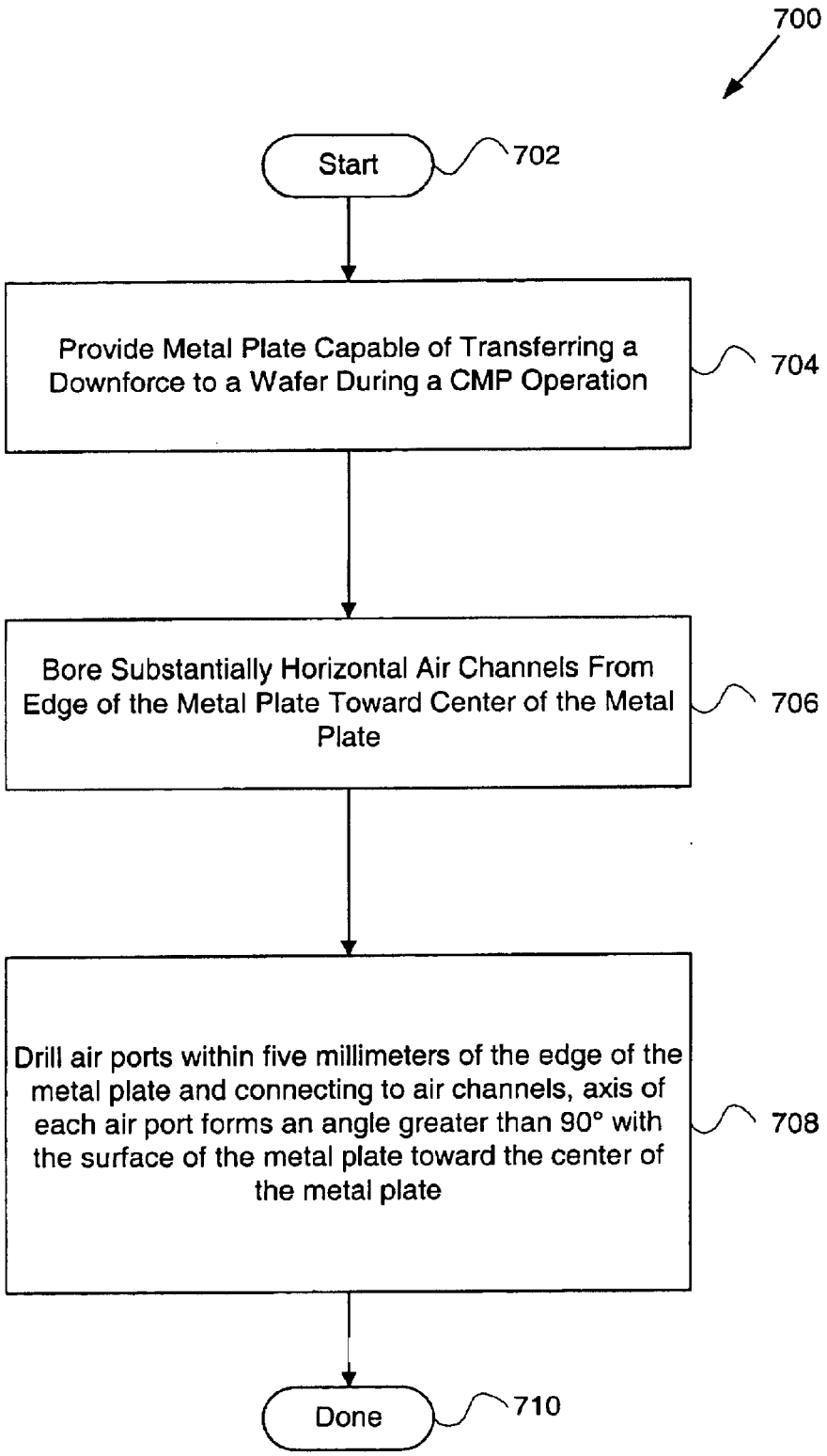
FIG. 7 is flowchart showing a method for making a carrier head having location optimized vacuum holes, in accordance with an embodiment of the present invention.

FIG. 7 is a flowchart showing a method 700 for making a carrier head having location optimized vacuum holes, in accordance with an embodiment of the present invention. In an initial operation 702, preprocess operations are performed. Preprocess operations can include defining a wafer size that will be supported, determining whether the carrier head will be utilized in a linear CMP system or a table based CMP system, and other preprocess operations that will be apparent to those skilled in the art after a careful reading of the present disclosure.

In operation 704, a metal plate is provided that is capable of transferring a downforce to a wafer during a CMP operation. Generally, the metal used to manufacture the plate is stainless steel. However, it should be noted that any type of material capable of transferring force to a wafer can be used in manufacturing the plate. For example, other metals, plastics, or any other material usable in carrier heads in CMP processes can be utilized in place of the stainless steel. Optionally, a gimbal assembly can be included on the stainless steel plate to provide enhanced flexibility during the CMP process. Further, receptacles for shear pins can be included to allow shear pins to transfer rotational force to the metal plate during polishing operations.

In operations 706, a plurality of substantially horizontal air channels are bored from the edge of the metal plate toward a center of the metal plate. Once drilled, air channel plugs are set into the ends of the air channels along the edge of the stainless steel plate. In operation, the air channels provide air to the air ports, discussed subsequently. To prevent the air pressure from escaping out the edge of the metal plate, plugs are inserted into each air channel along the edge of the metal plate. Preferably the plugs have width that is wide enough to substantially prevent air leakage, yet continue to allow air to be provided to the air ports.

A plurality of air ports are drilled within five millimeters of the edge of the metal plate and connected to the air channels, in operation 708. As mentioned previously, each air port is manufactured to have an angle that is greater than 90° relative to a plane that is parallel to the surface of the wafer. Preferably the angle is in a range of about 90° to 145°. In addition, the angle preferably is configured to tilt directionally toward the center of the wafer and in a plane substantially perpendicular to the surface of the wafer.

As discussed above, air is provided through the air channels and connecting air ports, and out the vacuum holes after transporting the wafer to its destination to release the wafer from the carrier head. Since the air ports are tilted toward the center of the wafer, the air pressure is provided toward the center of the wafer and shears the wafer from the surface of the carrier film. The tilt of the air ports prevents the air pressure from escaping out the edge of wafer, which would prevent release of the wafer.

Post process operations are performed in operation 710. Post process operations can include, for example, attaching a retaining ring to the carrier head, positioning a carrier film over the surface of the metal plate, and other post process operations that will be apparent to those skilled in the art after a careful reading of the present disclosure. Once manufactured, embodiments of the present invention can be advantageously utilized to polish wafers without generating low removal rate vacuum hole regions of the wafer surface. In particular, each vacuum hole is positioned within the edge exclusion zone of the wafer during the CMP operation. Because devices are not fabricated in this area of the wafer, removal rates are much less important within the edge exclusion of the wafer. Further, the edge of a wafer is much more ridged than the center areas of the wafer. Thus, the physics of the wafer itself make points on the edge of the wafer much stiffer than points located more centrally on the wafer. As a result, the vacuum holes have much less affect on the wafer removal rate when located within 3 millimeters of the wafer's edge, such when located at 2.7 millimeters from the edge of the wafer.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A carrier head for use in a chemical mechanical planarization (CMP) process, comprising:

a metal plate capable of transferring a downforce to a wafer during a CMP operation; and a plurality of vacuum holes disposed within and through the metal plate, wherein each vacuum hole is limited to placement that is within five millimeters of an outer edge of the wafer.

2. A carrier head as recited in claim 1, wherein each vacuum hole is positioned such that the vacuum hole is within an edge exclusion zone of the wafer during the CMP operation.

3. A carrier head as recited in claim 1, wherein each vacuum hole is positioned such that the vacuum hole is within three millimeters of the edge of the wafer during the CMP operation.

4. A carrier head as recited in claim 3, wherein each vacuum hole is positioned such that the vacuum hole is 2.7 millimeters from the edge of the wafer during the CMP operation.

5. A carrier head as recited in claim 1, further comprising a plurality of air ports, each air port being connected to a vacuum hole, wherein an axis of each air port forms an angle greater than 90° relative to a plane that is parallel to a surface of the wafer toward a center of the wafer and in a plane substantially perpendicular to the surface of the wafer.

6. A carrier head as recited in claim 5, wherein the angle is in a range of about 90° to 145°.

7. A carrier head as recited in claim 6, wherein each air port is capable of providing air pressure toward the center of the wafer to release the wafer from the carrier head.

8. A method for making a carrier head for use in a chemical mechanical planarization (CMP) process, comprising the operations of:

providing a metal plate capable of transferring a downforce to a wafer during a CMP operation;

boring a plurality of substantially horizontal air channels from an edge of the metal plate toward a center of the metal plate; and drilling a plurality of air ports into the metal plate, each air port being located within five millimeters of the edge of the metal plate, each air port being connected to an air channel, wherein an axis of each air port forms an angle greater than 90° relative to a plane that is parallel to the surface of the metal plate toward the center of the metal plate and in a plane substantially perpendicular to the surface of the metal plate, and wherein an end of each air port forms a vacuum hole in the surface of the metal plate.

9. A method as recited in claim 8, further comprising the operation of plugging an end of each horizontal air channel present at the edge of the metal plate.

10. A method as recited in claim 8, wherein each vacuum hole is positioned such that the vacuum hole is within an edge exclusion zone of the wafer during the CMP operation.

11. A method as recited in claim 8, wherein each vacuum hole is positioned such that the vacuum hole is 2.7 millimeters from an edge of the wafer during the CMP operation.

12. A method as recited in claim 8, wherein the angle is in a range of about 90° to 145°.

13. A method as recited in claim 12, wherein each air port is capable of providing air pressure toward the center of the wafer to release the wafer from the carrier head.

14. A method as recited in claim 13, wherein each air port is further capable of providing a vacuum to a backside of the wafer to adhere the wafer to the carrier head.

15. A carrier head for use in a chemical mechanical planarization (CMP) process, comprising:

a metal plate capable of transferring a downforce to a wafer during a CMP operation;

a plurality of substantially horizontal air channels extending from an edge of the metal plate toward a center of the metal plate; and a plurality of vacuum holes disposed within the metal plate and connected to the plurality of air channels via air ports, wherein an axis of each air port forms an angle greater than 90° relative to a plane that is parallel to a surface of the wafer toward a center of the wafer, and wherein each vacuum hole is positioned such that the vacuum hole is within an edge exclusion zone of the wafer during the CMP operation.

16. A carrier head as recited in claim 15, wherein each vacuum hole is positioned such that the vacuum hole is within five millimeters of an edge of the wafer during the CMP operation.

17. A carrier head as recited in claim 16, wherein each vacuum hole is positioned such that the vacuum hole is within three millimeters of the edge of the wafer during the CMP operation.

18. A carrier head as recited in claim 17, wherein each vacuum hole is positioned such that the vacuum hole is 2.7 millimeters from the edge of the wafer during the CMP operation.

19. A carrier head as recited in claim 15, wherein the angle is in a range of about 90° to 145°.

20. A carrier head as recited in claim 19, wherein each air port is capable of providing air pressure toward the center of the wafer to release the wafer from the carrier head.

* * * * *